US007147047B2

(12) United States Patent
Wölk

(10) Patent No.: US 7,147,047 B2
(45) Date of Patent: Dec. 12, 2006

(54) HEAT EXCHANGER

(75) Inventor: Gerrit Wölk, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/506,973

(22) PCT Filed: Feb. 24, 2003

(86) PCT No.: PCT/EP03/01852

§ 371 (c)(1),
(2), (4) Date: Sep. 8, 2004

(87) PCT Pub. No.: WO03/076860

PCT Pub. Date: Sep. 18, 2003

(65) Prior Publication Data

US 2005/0126767 A1 Jun. 16, 2005

(30) Foreign Application Priority Data

Mar. 9, 2002 (DE) ..... 102 10 458
Oct. 24, 2002 (DE) ..... 102 49 451

(51) Int. Cl.
*F28D 1/053* (2006.01)

(52) U.S. Cl. ..... 165/152; 165/DIG. 487

(58) Field of Classification Search ..... None
See application file for complete search history.

(56) References Cited

U.S. PATENT DOCUMENTS 1,522,404 A * 1/1925 Albach ..... 165/152
2,093,256 A * 9/1937 Still ..... 165/152
2,119,761 A * 6/1938 Wentworth ..... 165/150
3,045,979 A * 7/1962 Huggins et al. ..... 165/152
3,724,538 A * 4/1973 Yamaguchi et al. ..... 165/152
4,469,168 A * 9/1984 Itoh et al. ..... 165/152
4,615,384 A * 10/1986 Shimada et al. ..... 165/152
4,676,304 A 6/1987 Koisuka et al.
5,341,870 A * 8/1994 Hughes et al. ..... 165/110
5,816,320 A 10/1998 Arnold et al.
6,357,518 B1 * 3/2002 Sugimoto et al. ..... 165/140
6,435,268 B1 * 8/2002 Bhatti et al. ..... 165/111
6,805,193 B1 * 10/2004 Hu et al. ..... 165/181
6,840,312 B1 * 1/2005 Sandberg ..... 165/152
6,889,757 B1 * 5/2005 Iwasaki et al. ..... 165/135
6,907,919 B1 * 6/2005 Zhang ..... 165/109.1

(Continued)

FOREIGN PATENT DOCUMENTS

DE 198 13 989 A1 9/1999

(Continued)

*Primary Examiner*—Allen J. Flanigan
(74) *Attorney, Agent, or Firm*—Foley & Lardner LLP

(57) ABSTRACT

The invention relates to a heat exchanger (1), especially for motor vehicles, which comprises flat pipes (2) through whose interior a first fluid (FL1) flows and that can be impinged upon externally by a second fluid (FL2). The flat pipes (2) are substantially disposed at an angle to the direction of flow (S2) of the second fluid (FL2) and parallel relative one another and are spaced apart so as to configure flow paths for the second fluid (FL2) that extend through the heat exchanger. Cooling ribs (3) are disposed in the flow paths and extend between respective adjacent flat pipes (2). A plurality of wavy ribs (3) are provided as the cooling ribs. These wavy ribs are disposed one behind the other in the direction of flow (S2) of the second fluid (FL2) and are off-set from one another in the direction of flow (S1) of the first fluid (FL1).

10 Claims, 8 Drawing Sheets

U.S. PATENT DOCUMENTS

2001/0027857 A1* 10/2001 Emrich et al. ..... 165/109.1

FOREIGN PATENT DOCUMENTS

GB 2 220 259 A 1/1990
JP 9-61081 A 3/1997
JP 11-147149 A 6/1999
WO WO 00/63631 A2 10/2000

* cited by examiner

Fig.
10a
11
12
5a
10b
13
14
5b
10c
15
16
5c
10d
17
18
19
5d
10e
20
21
22
23
5e
10f
24
25
26
27
28
5f
10g
29
30
31
32
33
5g
10h
34
35
36
37
38
5h
39
41
40
5i
10i
42
44
43
5j
10j

HEAT EXCHANGER

BACKGROUND OF THE INVENTION

The invention relates to a heat exchanger, especially one for motor vehicles.

Such a heat exchanger is disclosed, for example, by DE 198 13 989 A1. This heat exchanger may take the form, for example, of a condenser for an air conditioning system for motor vehicles. Alternatively the heat exchanger may take the form, for example, of a radiator which serves for cooling the coolant of a coolant circuit in a motor vehicle. The heat exchanger has a number of flat tubes arranged side by side and running parallel to one another, that is to say tubes the cross-section of which is fundamentally rectangular. Flowing in these flat tubes is a first fluid, such as a coolant in the case of a radiator or a gaseous refrigerant that is to be condensed, in the case of a condenser for an air conditioning system. The flat tubes are connected to manifolds or collecting pipes and exposed to the flow of a second fluid, such as ambient air, in order to produce a transfer of heat between the fluids. Flow paths for the second fluid are formed between the spaced individual flat tubes.

In order to improve the heat transfer between the fluids, cooling fins are arranged between the flat tubes and fixed to the latter. In the heat exchanger disclosed by DE 198 13 989 A1, the surfaces of the cooling areas are fundamentally situated transversely to the direction of flow of the second fluid. This means that there is a considerable flow resistance to the second fluid. Designing the cooling fins to obstruct the flow is purposely intended to reduce the rate of flow of the second fluid. This, on the one hand, increases the time which the second fluid spends flowing through the heat exchanger, that is to say the time in which the second fluid can absorb heat from the first fluid or transmit heat to this. On the other hand, however, the low rate of flow of the second fluid limits the amount of heat transferable between the first and the second fluid, that is to say the efficiency of the heat exchanger.

A further heat exchanger with cooling fins is disclosed, for example, by U.S. Pat. No. 4,676,304. In this heat exchanger the cooling fins lie fundamentally parallel to the direction of flow of the second fluid (in this case, air). Despite the formation of baffle louvers on the individual cooling fins, it is nevertheless impossible to prevent some of the second fluid that flows through the heat exchanger from flowing between adjacent cooling fins without absorbing significant amounts of energy from these or giving off energy to these fins. This problem is particularly important when the heat exchanger has small dimensions in the direction of flow of the second fluid. In this case a high mass flow of the second fluid does not necessarily result in a high heat transfer coefficient. Only a relative small proportion of the available temperature difference between the first and second fluid is utilized.

SUMMARY OF THE INVENTION

The object of the invention is to specify a heat exchanger, especially one for motor vehicles, having flat tubes and cooling fins which are specially designed to promote flow and which at the same time ensure a high heat transfer coefficient.

According to the invention, the heat exchanger has flat tubes through which a first fluid can flow and which can be externally exposed to a second fluid, and which are arranged fundamentally parallel to one another and transversely to the direction of flow of the second fluid, in such a way that flow paths for the second fluid are formed, in which cooling fins are arranged, which in each case extend between adjacent flat tubes. The cooling fins here take the form of corrugated fins, multiple corrugated fins being arranged in series in the direction of flow of the second fluid and laterally offset in relation to one another, that is offset in the direction of flow of the first fluid. Successively offsetting the corrugated fins means that a very high proportion of the second fluid flowing through the heat exchanger is used for heat transfer. In the case of corrugated fins with gills, a greater overall mass flow of the second fluid may possibly flow through gills that are arranged in the area of that side of a fin on the downstream side for the second fluid than is the case without an offset between the corrugated fins. This may give rise to an increased heat transfer coefficient in this area. In addition, this has an influence on a thermal boundary layer, which may form at a tube wall, so that any heat transfer from the tube wall to the second fluid or vice-versa may be increased.

A flow-enhancing design for the corrugated fins is preferably achieved in that their surfaces lie fundamentally parallel to the direction of flow of the second fluid, that is to say the normals to the surfaces of the corrugated fins fundamentally enclose a right angle with the direction of flow of the second fluid. This flow-enhancing design of the corrugated fins notwithstanding, the lateral offsetting of corrugated fins arranged in series ensures that only a smaller proportion of the second fluid flows between the flat tubes unused, that is to say without significant heat transfer, than is the case without such an offset. This advantage is all the more manifest the greater the spacing b between two fins. Two or three similarly shaped corrugated fins are preferably successively offset in relation to one another. In order to ensure a high heat transfer coefficient, the individual corrugated fins are preferably arranged directly adjoining one another, that is to say without any spacing in the direction of flow of the second fluid. This gives a large heat exchanger surface. Alternatively, a spaced arrangement of in this case narrower corrugated fins may be provided in order to reduce the flow resistance.

According to a preferred development, the corrugated fins have gills to direct the second fluid. A so-called swelling flow developing at the gills, which has a high temperature gradient in one area of the corrugated fin, ensures a better heat transfer between the second fluid and the corrugated fins.

All gills of a fin section enclosed between two flat tubes are preferably angled in the same direction in relation to the direction of flow of the second fluid. A uniform angling of the gills within a fin section has the advantage that, where necessary, the flow can thereby be purposely directed towards a downstream fin section.

The gills of successively offset fin sections are preferably angled in opposite directions, so as to define a longer flow path for the second fluid flowing through the heat exchanger. The gills of two adjacent gilled panels may also be angled in the same direction, it then possibly being advantageous for the gills of a gilled panel arranged upstream or downstream of the two adjacent gilled panels to be angled in the opposite direction to the gills of the two adjacent gilled panels.

A uniform coverage of the flow cross-section through which the second fluid passes is preferably achieved in that successively offset fin sections run parallel to one another. In this case the offset fin sections are preferably perpendicular to the flat tubes. If the fin surfaces deviate somewhat (up to approximately 6 degrees) from parallel, these surfaces in the context of the invention still being regarded as substantially parallel, this has scarcely any adverse effect on the thermodynamic advantages of the offset fins. The use of so-called V-fins or fins with any degree of rounding is equally feasible. The fin geometry according to the invention can be used, in particular, in motor vehicle heat exchangers such as radiators, heating elements, condensers and evaporators.

Multiple successive corrugated fins are preferably formed from one common strip and this has advantages in terms of production engineering. The corrugated fins including the gills can be manufactured, in particular, by rolling from a metal strip. Further production engineering advantages accrue if an odd number of corrugated fins, for example three or five corrugated fins, are rolled from one strip.

According to an advantageous development of the invention a gill depth LP in the range from 0.7 to 3 mm at a gill angle of 20 to 30 degrees improves efficiency, because this increases the flow angle, that is to say the deflection of the second fluid from one channel into the adjacent channel, in turn producing a longer flow path for the second fluid. The fin height for such a system advantageously lies in the range from 4 to 12 mm. The fin density for this system advantageously lies in the range from 40 to 85 fins/dm, corresponding to a fin interval or fin spacing of 1.18 to 2.5 mm.

BRIEF DESCRIPTION OF THE DRAWINGS

Examples of embodiments of the invention will be explained in more detail below with reference to a drawing, in which.

DETAILED DESCRIPTION OF THE INVENTION

Figure 1A:
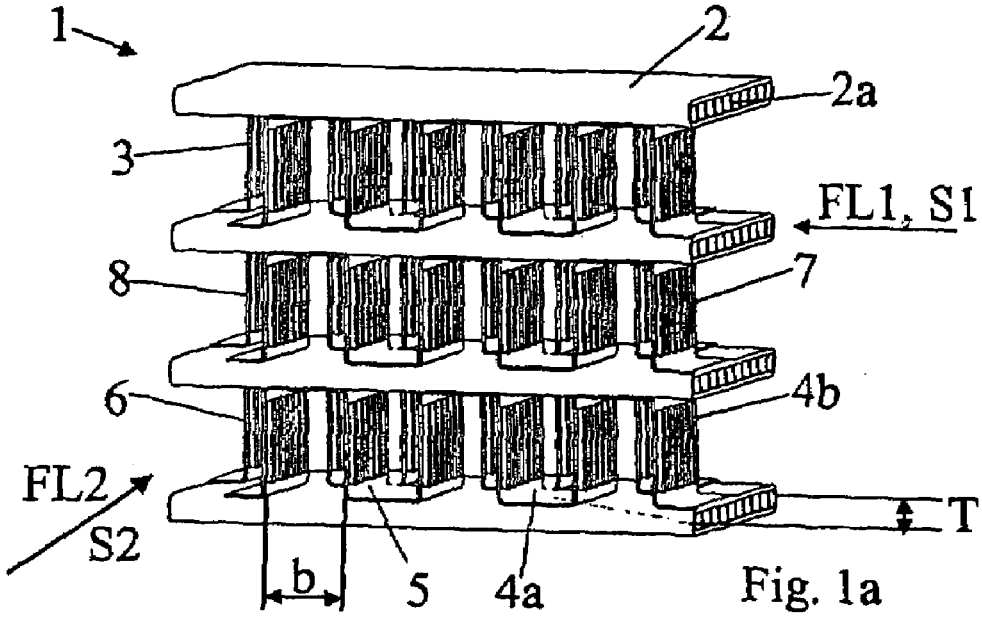
FIG. 1*a*, 1*b* shows a heat exchanger having two successively offset corrugated fins as cooling fins between each two adjacent flat tubes.
Figure 1B:
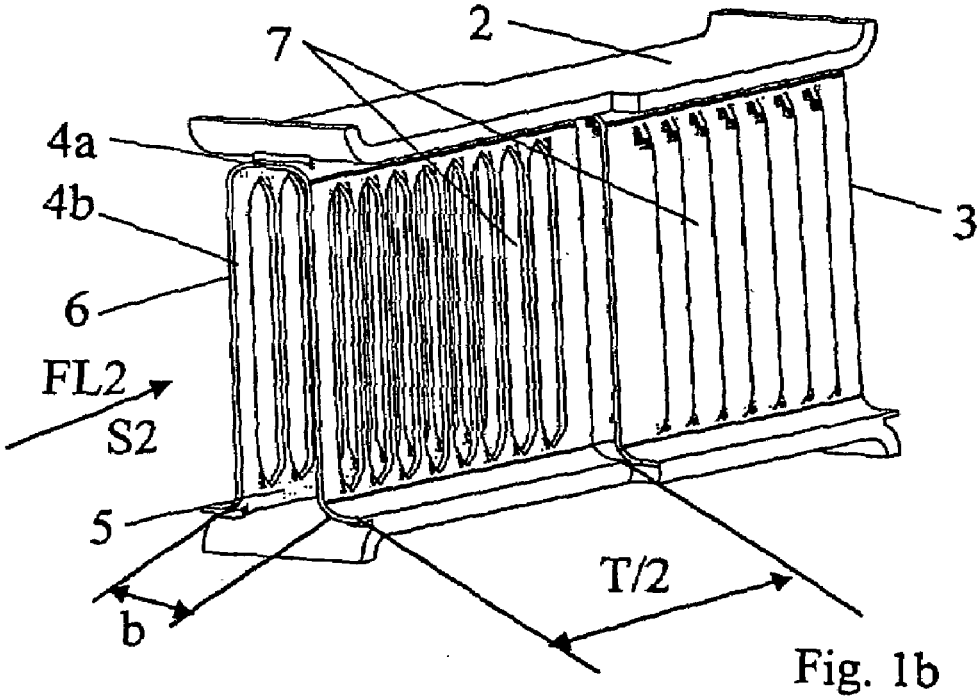
Figure 2A:
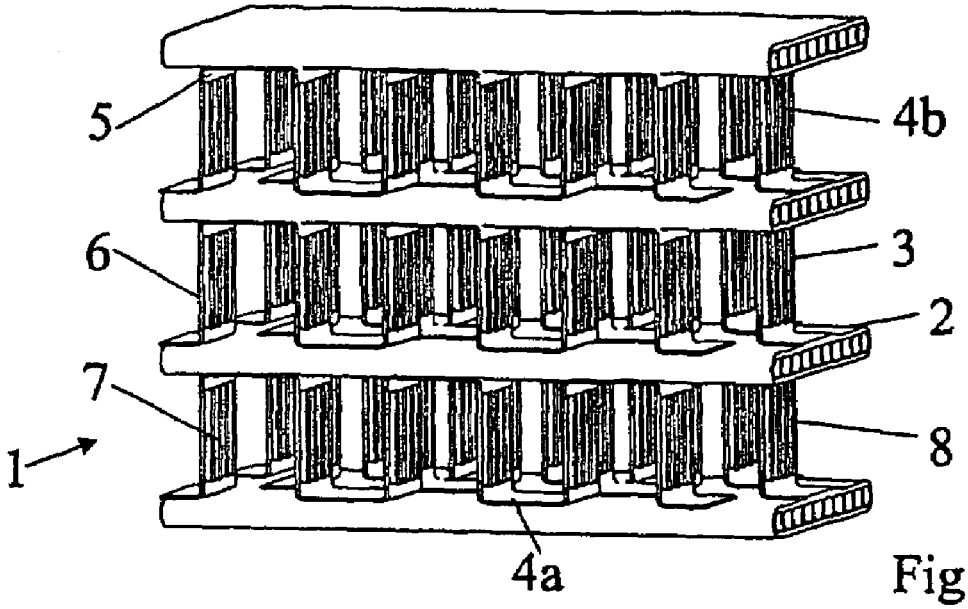
FIG. 2*a*, 2*b* shows a heat exchanger having three successively offset corrugated fins as cooling fins between each two adjacent flat tubes.
Figure 2B:
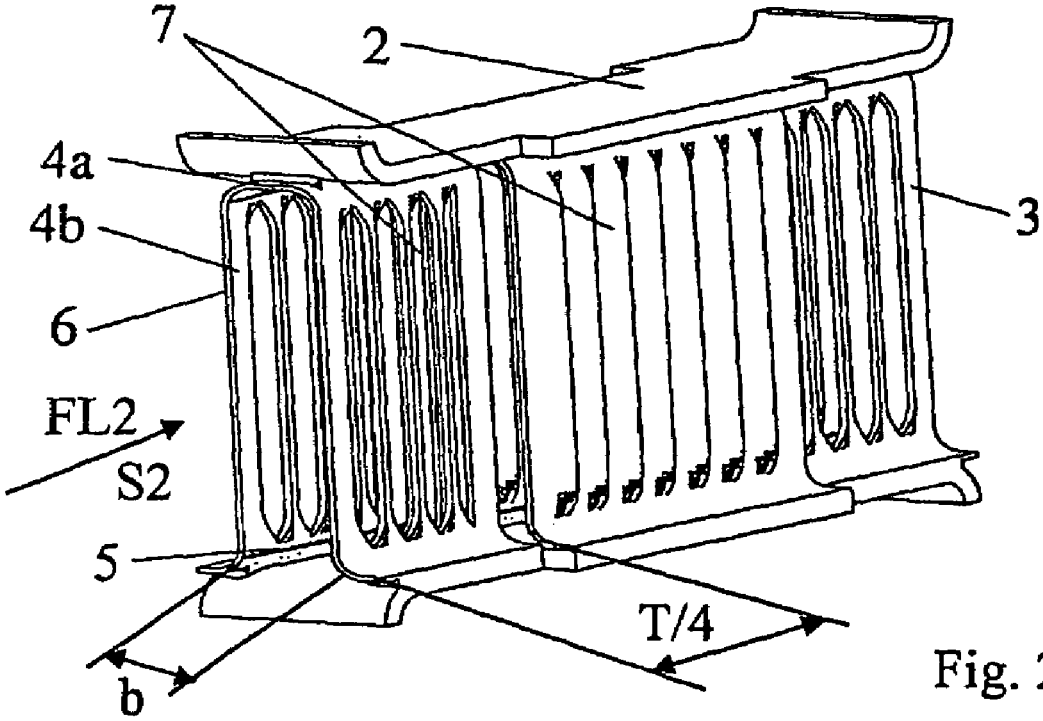

Corresponding parts are provided with the same reference numerals in all figures.

FIGS. 1*a*, 1*b* and 2*a*, 2*b* show sections from a heat exchanger 1 with flat tubes 2 which are arranged parallel to one another and through which a first fluid FL1 flows in a first direction of flow S1. The flat tubes 2 are fitted with flow baffle elements 2*a* and are connected to manifolds or collecting pipes (not shown). The fluid FL1 is a coolant, for example, or a refrigerant condensing in the heat exchanger 1.

Two (FIG. 1*a*, 1*b*) or three (FIG. 2*a*, 2*b*) corrugated fins 3 are arranged as cooling fins between each two adjacent flat tubes 2. Embodiments with a greater number of corrugated fins 3 are also feasible. The corrugated fins 3 are bent in a square-wave shape from a sheet, a fin section 4*a* adjoining a flat tube 2 in each case alternating with a fin section 4*b* connecting two adjacent flat tubes 2. The fin sections 4*a* adjoining the flat tubes 2 are connected to the flat tubes by a heat-conducting method, in particular by brazing. The fin sections 4*b* connecting two adjacent flat tubes 2 are perpendicular to the flat tubes 2 and form flow paths for a second fluid FL2, for example air, which flows through the heat exchanger 1 in the direction of flow S2. The second fluid FL2 flows largely parallel to the surface 5 of the corrugated fins 3, that is to say as it flows into the heat exchanger 1 the second fluid FL2 is initially only incident upon the narrow end faces 6 of the corrugated fins 3. The second fluid FL2 can thereby flow through the heat exchanger 1 at high speed and with a correspondingly high mass flow.

Figure 3:
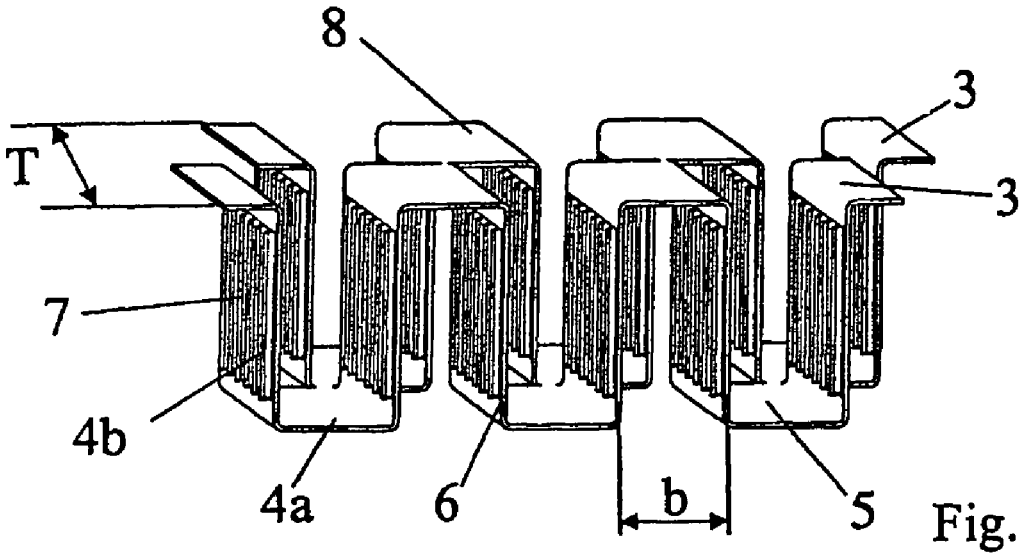
FIG. 3 shows two corrugated fins formed from a single strip.
Figure 4:
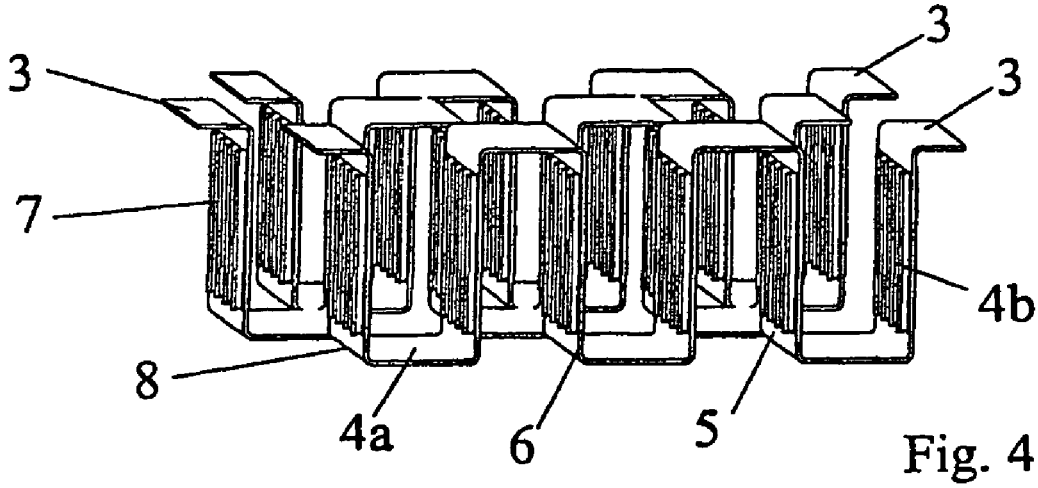
FIG. 4 shows three corrugated fins formed from a single strip.

Gills 7, which extend transversely to the direction of flow S2 of the second Fluid FL2 and transversely to the direction of flow S1 of the first fluid FL1 are formed out of the fin sections 4*b*, as can be seen in particular from FIGS. 3, 4. The gills 7 within a fin section 4*b* on the one hand produce an especially good heat transfer between the second fluid FL2 and this fin section 4*b*, and on the other purposely direct the second fluid FL2 to the fin section 4*b* arranged obliquely behind in the direction of flow S2. In this way virtually full use is made of the mass flow of the second fluid FL2 passing through the heat exchanger 1, efficiently exploiting the temperature difference between the first fluid FL1 and the second fluid FL for the transfer of heat.

Two corrugated fins 3 arranged in series between two flat tubes 2 are offset in relation to one another by half the width b between two adjacent fin sections 4*b*. In the case of three corrugated fins 3 arranged in series, as shown in FIGS. 2 and 4, an offset of b/3 may also be selected for preference, other offset values also being feasible.

Two or three adjacent corrugated fins 3, which extend over the depth T of the heat exchanger 1, are produced by rolling from one sheet 8. In rolling, the sheet 8 is cut in the area of the respective offset between the two (FIG. 1*a*, 1*b*, FIG. 3) or three (FIG. 2*a*, 2*b*, FIG. 4) corrugated fins 3 and the gills 7 are cut into the corrugated fins 3. A single (FIG. 1*a*, 1*b*, FIG. 3, FIG. 5*c*) or double (FIG. 2*a*, 2*b*, FIG. 4, FIG.

5*d*) offset or offset of a higher order (FIG. 5*e*, 5*f*, 5*g*) of the corrugated fins 3 can alternatively be produced by arranging similar, separate corrugated fins 3 with an offset of between 0.1 mm and b/2, b being the distance between two adjacent flat tubes 2.

The fin sections 4*a* of the corrugated fins 3 adjoining the flat tubes 2 do not have any gills. In this area therefore a laminar flow of the fluid FL2 tends to form more readily than in the fin sections 4*b* that are provided with gills 7 and which connect the adjacent flat tubes 2. Over a longer distance the laminar flow may lead to the formation of a boundary layer with falling temperature gradient at the flat tube 2. This effect is limited to an insignificant amount in that the flow of the second fluid FL2 forming between two adjacent fin sections 4*b* of a corrugated fin 3 is already disrupted even after the short distance T/2 (FIG. 1*a*, 1*b*, FIG. 3, FIG. 5*c*) or T/4 (FIG. 2*a*, 2*b*, FIG. 4, FIG. 5*d*) by the succeeding corrugated fin 3 in the direction of flow S2, so that an increase in the temperature gradient is generated, which causes an increase in the heat transfer.

In this way a highly efficient heat transfer is achieved between the second fluid FL2 and the first fluid FL1 even in a heat exchanger 1 with a low depth T of 12 to 20 mm, for example.

Figure 5:
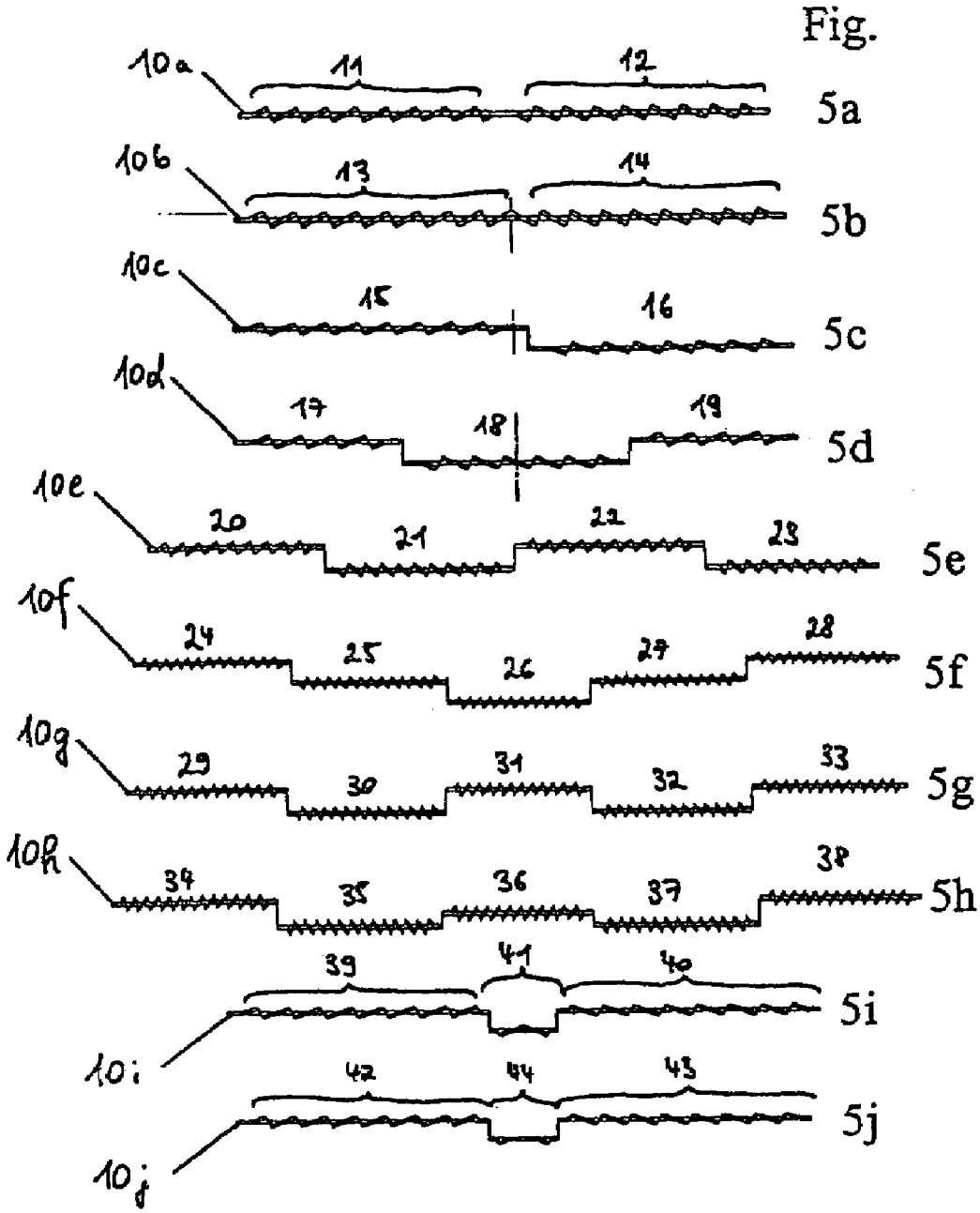
FIG. 5*a* shows a cross-section of a corrugated fin without offset having two gilled panels.
FIG. 5*b* shows a cross-section of a corrugated fin without offset having two gilled panels.
FIG. 5*c* shows a cross-section of a corrugated fin from one strip having 2 rows.
FIG. 5*d* shows a cross-section of a corrugated fin from one strip having 3 rows.
FIG. 5*e* shows a cross-section of a corrugated fin from one strip having 4 rows.
FIG. 5*f* shows a cross-section of a corrugated fin from one strip having 5 rows.
FIG. 5*g* shows a cross-section of a corrugated fin from one strip having 5 rows.
FIG. 5*h* shows a cross-section of a corrugated fin from one strip having 5 rows.
FIG. 5*i* shows a cross-section of a corrugated fin from one strip having 3 rows.
FIG. 5*j* shows a cross-section of a corrugated fin from one strip having 3 rows.

FIG. 5 shows cross-sections of corrugated fins 10*a,b . . . j* each with multiple gilled panels. In cooling fins of prior art with baffle louvers (gills) in the individual fins, a fin between two tubes in the main direction of flow of the second fluid usually lies solely in one plane without offset (FIG. 5*a*, 5*b*). These cooling fins have at least two so-called gilled panels 11, 12, and 13, 14 respectively, which are separated from one another by a web of varying design. The baffle louvers (gills) of adjacent gilled panels are in this case usually aligned in opposite directions.

According to the present invention two, three or even more similarly shaped corrugated fins (cooling fins) are preferably successively offset in relation to one another, that is to say the one corrugated fin with baffle louvers (gills) may be offset in multiple planes. At the same time the number of corrugated fins which are arranged in series, viewed in the direction of flow of the second fluid, may be chosen as a function of the depth of the heat exchanger and/or the depth of the corrugated fins. For example, 2, 3 or more rows may be used for an overall depth of 12 to 18 mm, 2, 3, 4 or more rows for an overall depth of up to 24 mm, 2, 3, 4, 5 or more rows for an overall depth of up to 30 mm, 2, 3, 4, 5, 6 or more rows for an overall depth of up to 36 mm, 2, 3, 4, 5, 6, 7 or more rows for an overall depth of up to 42 mm, 2, 3, 4, 5, 6, 7, 8 or more rows for an overall depth of up to 48 mm, 2, 3, 4, 5, 6 7, 8, 9 or more rows for an overall depth of up to 54 mm, 2, 3, 4, 5, 6, 7, 8, 9, 10 or more rows for an overall depth of up to 60 mm, and 2, 3, 4, 5, 6, 7, 8, 9, 10, 11 or more rows for an overall depth of up to 66 mm.

FIG. 5*c* shows a cross-sectional view of an example of an embodiment for 2 rows 15 and 16.

FIG. 5*d* shows a cross-sectional view of an example of an embodiment for 3 rows 17, 18 and 19.

FIG. 5*e* shows a cross-sectional view of an example of an embodiment for 4 rows 20, 21, 22 and 23.

FIG. 5*f* shows a cross-sectional view of an example of an embodiment for 5 rows 24, 25, 26, 27 and 28.

FIG. 5*g* shows a cross-sectional view of an example of an embodiment for 5 rows 29, 30, 31, 32, and 33.

FIG. 5*h* shows a cross-sectional view of an example of an embodiment for 5 rows 34, 35, 36, 37 and 38.

More than two offset rows can preferably be distributed on a total of two planes offset in relation to one another, as in the embodiments in FIGS. 5*d*, 5*e* and 5*g*. However, they can also be distributed on three or more different planes as in the embodiments in FIGS. 5*f* and 5*h*, the intervals between each two respective planes being either identical or different.

Alternatively, just the area 41 or 44 between two gilled panels 39, 40 and 42, 43 lying in one plane can be offset in relation to the gilled panels 39, 30 and 42, 43 (FIGS. 5*i* and 5*j*). In the area 41 or 44 the corrugated fin 10*i* and 10*j* respectively has no gills. This development, too, has an influence on the thermal boundary layer at the tube walls and/or improves the flow through the louvers.

The number of gills per row is between 2 and 30 gills, for example, depending on the number of rows and the depth of the heat exchanger. For production engineering reasons the number of gills per gill panel is preferably not identical in the case of an odd number of rows, that is 3, 5, 7, 9, or 11 rows. With an even number of rows, the number of gills per gilled panel may be identical, although this is not essential.

A simulation of an air flow through a heat exchanger having three different corrugated fin configurations is explained below (FIG. 6 to 9).

The simulation is performed under the following conditions: tube temperature=60°; air inlet temperature=45° C.; air density=1.097 kg/m3; air inlet velocity vL=1 and 3 m/s, fin height=8 mm, fin depth=16 mm. The simulation is partly based on a consideration of one corrugated fin in a row, that is without offset, consisting of a row with two gilled panels separated from one another by a roof-shaped web (prior art). In addition, one corrugated fin with 2 rows and one corrugated fin with 3 rows are considered. In addition to the air-side pressure drop, the simulation also determines the mass flow through the individual louvered openings and the radiated output from the tube to the cooling air.

Figure 6:
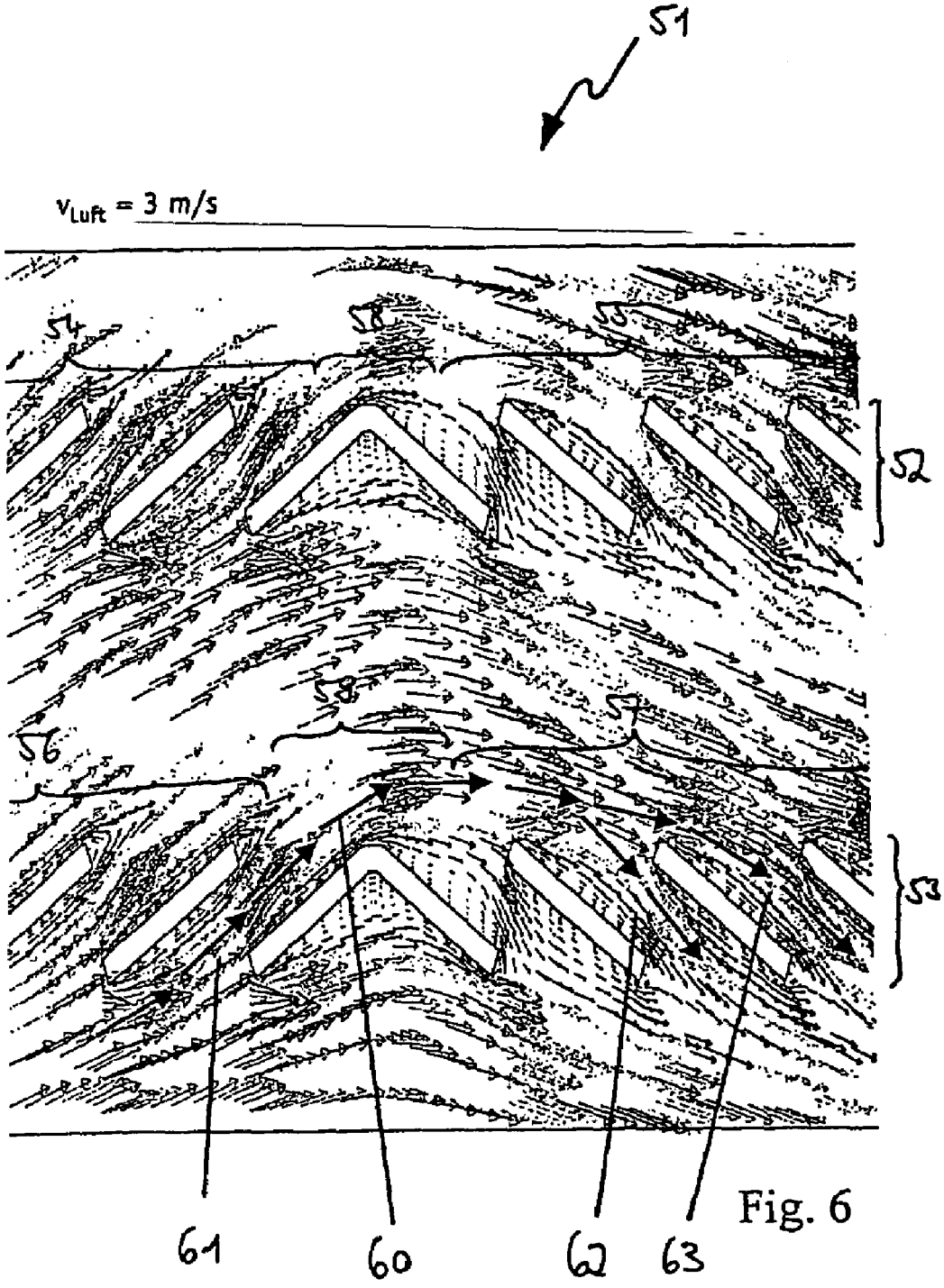
FIG. 6 shows a snapshot of a simulated air flow through corrugated fins without offset.

FIG. 6 shows the flow field of the air at an air inlet velocity $V_{Luft}$ of 3 m/s into a heat exchanger 51 having corrugated fins 52, 53 under the aforementioned boundary conditions in the area between two gilled panels 54, 55 and 56, 57 respectively. The webs 58 and 59 between each two gilled panels are in this case roof-shaped. The arrows 60 indicate the main flow path of the air particles, which flow through the last louvered opening 61 in front of the web 59, then experience a flow deflection before flowing through the louvered openings 62 and 63 in the adjacent gilled panel 57. It can be seen from the figure that it is not until the second louvered opening 62 of the gilled panel 57 that a higher number of air particles again flows through, and that it is only through the third louvered opening 63 that the velocity field again starts to approximate to the velocity pattern in the previous gilled panel 56.

Figure 7:
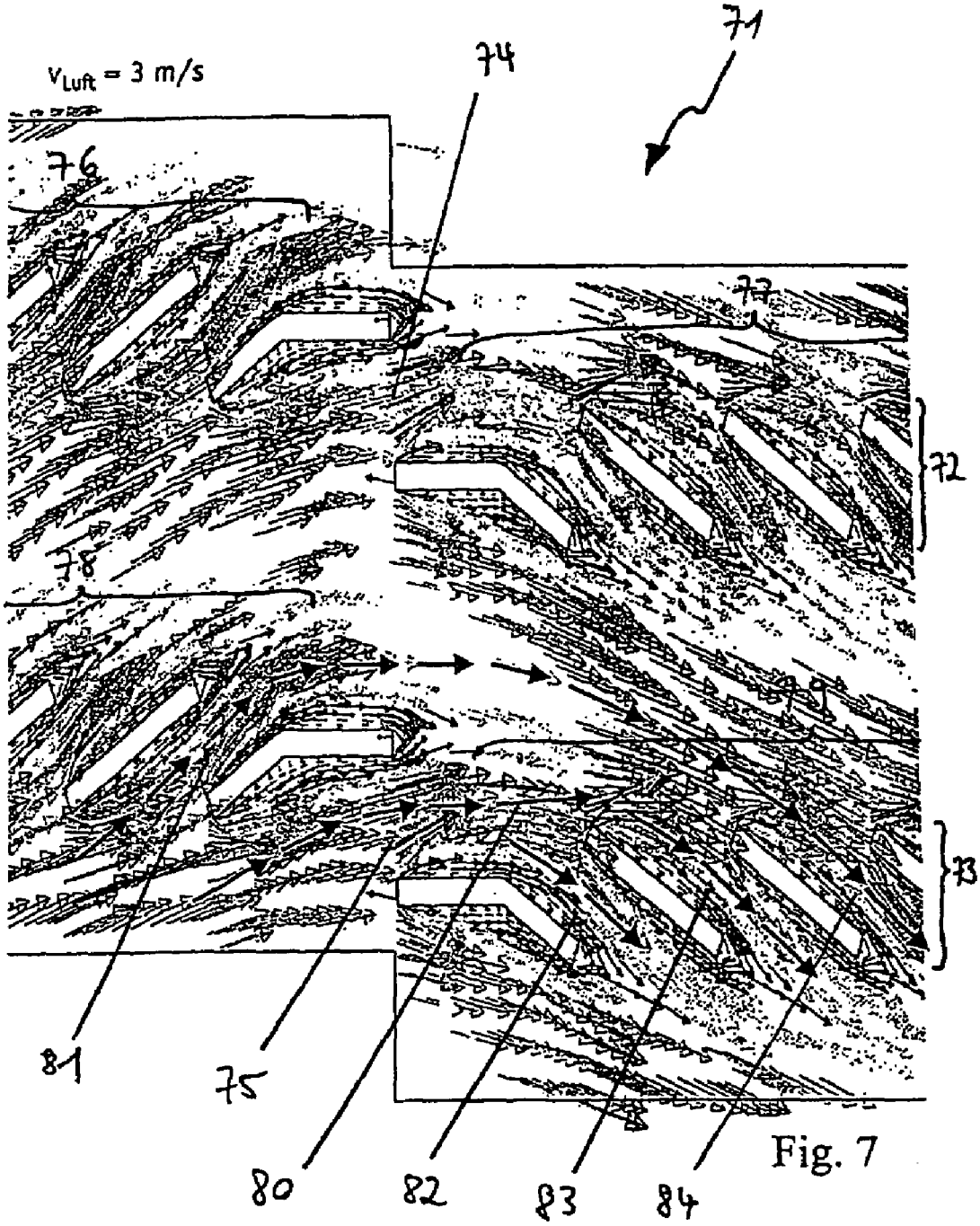
FIG. 7 shows a snapshot of a simulated air flow through corrugated fins with offset.

FIG. 7 shows the flow field of the air at an air inlet velocity $V_{Luft}$ of 3 m/s into a heat exchanger 71 having corrugated fins 72, 73 under the aforementioned boundary conditions in the area of an offset 74 and 75, in each case between two gilled panels 76, 77 and 78, 79 respectively. The arrows 80 indicate the main flow path of the air particles in front of the offset 75, firstly through the last louvered opening 81 in front of the offset and secondly through the offset opening 75. After flowing through the offset opening 75, the air particles experience a flow deflection, the air particles that flow through the offset opening then flowing primarily through first and second louvered opening 82, 83 of the adjacent gilled panel 79. After likewise experiencing a flow deflection, the air particles which flow through the last louvered opening 81 in front of the offset flow primarily through the third louvered opening 84 of the following gilled penal 79.

Figure 8:
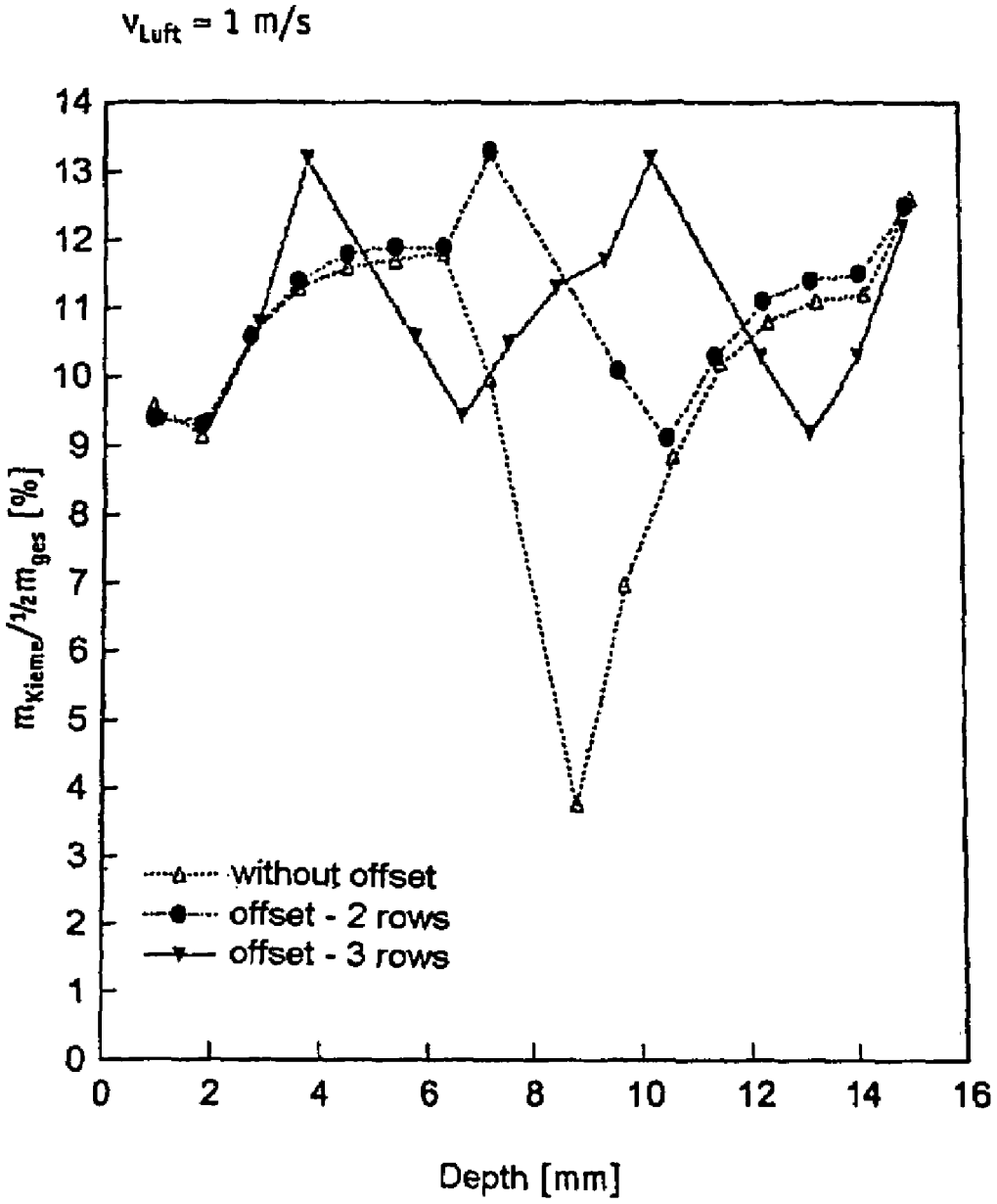
FIG. 8 shows a graph plotting an air mass flow flowing through a louvered opening as a proportion of a total air mass flow against the depth of the tubes for a low air flow rate.
Figure 9:
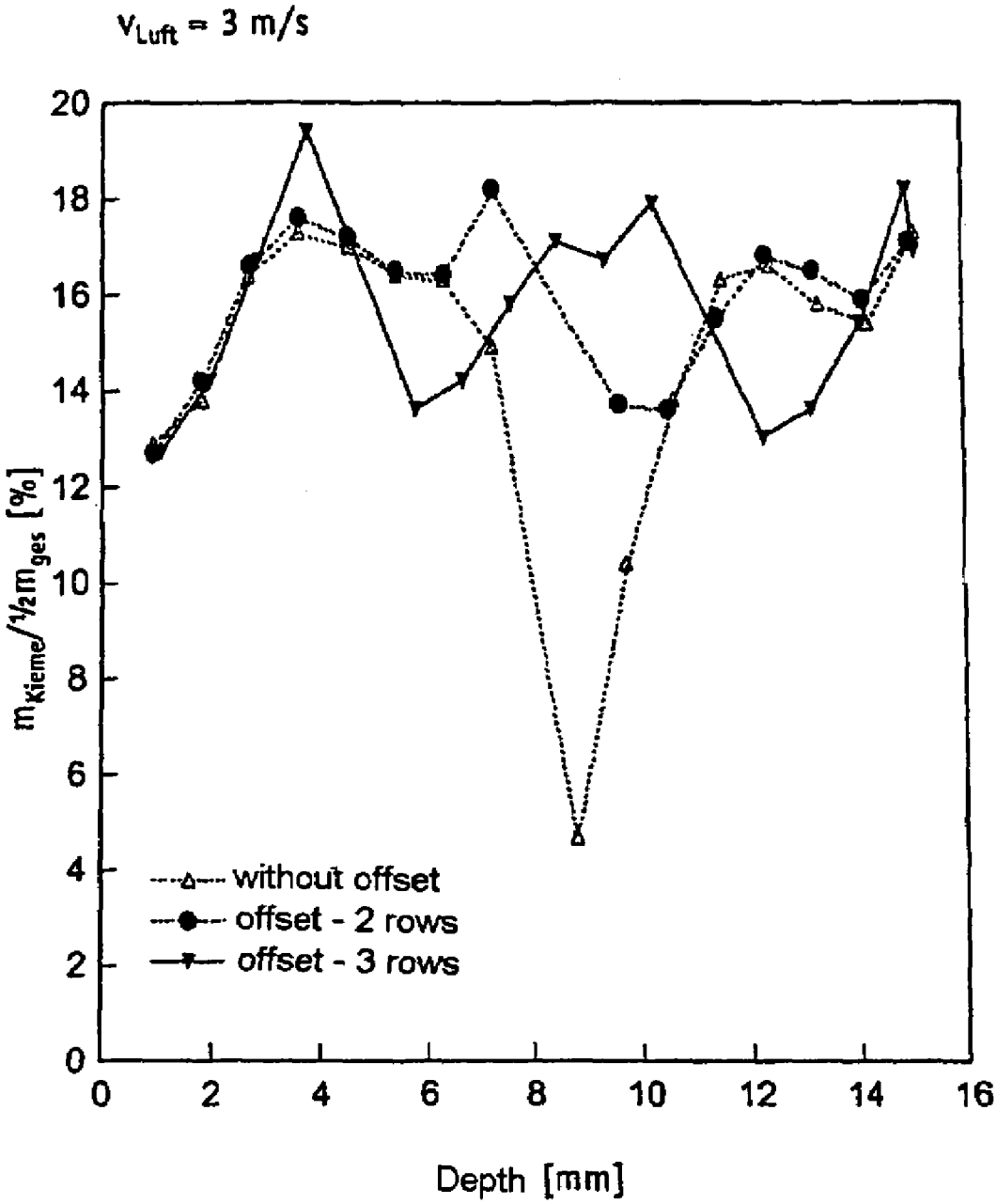
FIG. 9 shows a graph plotting an air mass flow flowing through a louvered opening as a proportion of a total air mass flow against the depth of the tubes for a high air flow rate.

FIGS. 8 and 9 show a graph of the ratio of the mass flow $m_{Kieme}$ through the respective gilled opening (louvered opening) to half the total mass flow ½ $m_{ges}$ of the air as fluid FL2 for the three different corrugated fin configurations at an air flow velocity of $V_{Luft}$=1 m/s (FIG. 8) and $V_{Luft}$=3 m/s (FIG. 9) under the boundary conditions described above, plotted against the depth of the tubes and the depth of the heat exchanger respectively, The percentage mass flow through the opening at the offset is not shown.

As can be seen from FIG. 8, the percentage air mass flow in the two corrugated fin configurations with two or three rows (one or two offsets) is always in excess of 9%, whereas in the case of corrugated fins in one plane/row the air mass flow in the two louvered openings adjoining the web area drops to less than 8% with a minimum of about 4%. Whilst the air mass flow in the case of the corrugated fin comprising one plane drops from approximately 12% to about 10% in the louvered opening in front of the web area, in the case of the corrugated fin comprising two planes/rows the mass flow through the last louvered opening in front of the offset here increases from approximately 12 to about 13%. This is again here followed after the offset by a re-orientation of the air flow and the first louvered opening is exposed only to a partial air mass flow of approximately 10%. In the case of the corrugated fin comprising three rows the mass flow through the last louvered opening in front of the offset likewise increases to approximately 13%. This is again here followed after the offsets by a re-orientation of the air flow and the first louvered opening is in each case exposed only to a partial air mass flow of approximately 10–11%.

As can be seen from FIG. 9, the percentage air mass flow in the two corrugated fin configurations with two or three rows (one or two offsets) is always in excess of 12%, whereas in the case of corrugated fins in one plane/row the air mass flow in the two louvered openings adjoining the web area drops to less than 11% with a minimum of about 4.5%. Whilst the air mass flow in the case of the corrugated fin comprising one plane drops from approximately 16.5% to about 15% in the louvered opening in front of the web area, in the case of the corrugated fin comprising two planes/rows the mass flow through the last louvered opening in front of the offset here increases from approximately 16.5 to about 18%. This is again here followed after the offset by a re-orientation of the air flow and the first louvered opening is exposed only to a partial air mass flow of approximately 14%. In the case of the corrugated fin comprising three rows the mass flow through the last louvered opening in front of the offset likewise increases to approximately 18–19%. This is again here followed after the offsets by a re-orientation of the air flow and the first louvered opening is in each case exposed only to a partial air mass flow of approximately 14%.

LIST OF REFERENCE NUMERALS

1 Heat exchanger
2 Flat tube
2*a* Flow baffle element
2 Corrugated fin, cooling fin
4*a,b* Fin section
5 Surface
6 End face
7 Gill
8 Strip
10*a–j* Corrugated fin
11–44 Gilled panel
b Width
FL1 First fluid
FL2 Second Fluid
S1 Direction of flow
S2 Direction of flow
T Depth

The invention claimed is:

1. A heat exchanger comprising:

a plurality of flat tubes through which a first fluid can flow and which can be externally exposed to a second fluid and which are arranged fundamentally parallel to one another and transversely to the direction of flow of the second fluid, wherein the flat tubes are spaced apart forming a plurality of flow paths for the second fluid passing through the heat exchanger;

a plurality of corrugated fins arranged in each flow path for the second fluid extending between two adjacent flat tubes;

wherein the plurality of corrugated fins in each flow path for the second fluid is arranged in series in the direction of the flow of the second fluid and laterally offset in relation to one another in their respective flow path;

wherein at least one of the corrugated fins in each flow path for the second fluid has gills for directing the second fluid; and wherein the fins are arranged laterally offset in a direction of the flow of the first fluid.

2. The heat exchanger as claimed in claim 1, wherein the surfaces of the corrugated fins are arranged fundamentally parallel to the direction of flow of the second fluid.

3. The heat exchanger as claimed in claim 1, wherein the plurality of corrugated fins in each flow path for the second fluid is similarly shaped.

4. The heat exchanger as claimed in claim 1, wherein all gills of a fin section bounded by two flat tubes are angled in the same direction relative to the direction of flow of the second fluid.

5. The heat exchanger as claimed in claim 4, wherein the gills of two successively offset fin sections are angled in the same direction.

6. The heat exchanger as claimed in claim 4, wherein the gills of two successively offset fin sections are angled in opposite directions.

7. The heat exchanger as claimed in claim 1, wherein two successively offset fin sections are fundamentally parallel to one another.

8. The heat exchanger as claimed in claim 7, wherein the fin sections are arranged fundamentally perpendicular to the flat tubes.

9. The heat exchanger as claimed in claim 1, wherein the corrugated fins extend for an equal or similar distance in a main direction of the flow of the second fluid.

10. The heat exchanger as claimed in claim 1, wherein the plurality of corrugated fins arranged in series is composed of a common strip.

* * * * *